US005839287A

United States Patent [19]

Stormo

[11] Patent Number: 5,839,287

[45] Date of Patent: Nov. 24, 1998

[54] SELECTABLE REFRIGERATOR OR FREEZER COMPARTMENT

[75] Inventor: Guy C. Stormo, St. Cloud, Minn.

[73] Assignee: White Consolidated Industries, Inc., Cleveland, Ohio

[21] Appl. No.: 813,855

[22] Filed: Mar. 7, 1997

[51] Int. Cl.[6] ..... F25D 17/06

[52] U.S. Cl. ..... 62/89; 62/407; 62/441

[58] Field of Search ..... 62/187, 441, 440, 62/404, 407, 408, 89

[56] References Cited

U.S. PATENT DOCUMENTS 3,050,955 8/1962 Solley, Jr. et al. ..... 62/155
3,726,578 4/1973 Armstrong .
4,304,101 12/1981 Gidseg .
4,467,618 8/1984 Gidseg .
4,614,092 9/1986 Kim et al. .
4,638,644 1/1987 Gidseg .
4,642,998 2/1987 Kang et al. .
4,689,966 9/1987 Nonaka .
4,876,860 10/1989 Negishi .
5,375,428 12/1994 LeClear et al. .
5,490,395 2/1996 Williams et al. ..... 62/187

*Primary Examiner*—John M. Sollecito
*Attorney, Agent, or Firm*—Pearne, Gordon, McCoy & Granger LLP

[57] ABSTRACT

Disclosed is a refrigerator-freezer unit having upper and lower storage compartments which are separated by a divider member. The lower compartment functions as a freezer and the upper compartment is selectively operable as either a freezer or a refrigerator.

16 Claims, 4 Drawing Sheets

SELECTABLE REFRIGERATOR OR FREEZER COMPARTMENT

BACKGROUND OF THE INVENTION

The present invention relates to a refrigerator-freezer unit having a freezer compartment and a second compartment which may be selected to provide a refrigerator or a freezer compartment.

It is becoming increasingly popular to use a second freezer or refrigerator in most homes. Typically, such units are kept in a garage or basement and serve as a supplemental storage area for frozen or refrigerated items. Having a second unit, in nearly all instances, provides more than enough storage space for items to be kept cold or frozen. A problem arises however, due to the fact that the entire unit is dedicated as either a freezer or a refrigerator. Accordingly, if a second freezer is kept in the basement or garage and is partially filled with frozen meat or garden products for example, that unit is unavailable if extra refrigerator space is needed, which often occurs when entertaining friends or family at one's home. Likewise, if a second refrigerator is kept in a garage or a basement such as for keeping beverages or refreshments cold, that unit is unavailable if additional freezer space is needed such as during the fall months if one is freezing garden products or bulk food materials which must be kept frozen. Although less pronounced, these drawbacks still exist if the second refrigerator has a freezer section or if the second freezer has a refrigerator section since such secondary freezer or refrigerator compartments are generally small. Accordingly, there is a need for a refrigerator-freezer having two or more compartments, in which at least one of the compartments may be selected to operate as either a refrigerator or a freezer compartment.

Refrigerator-freezer units having a selectable compartment are known in the prior art. U.S. Pat. No. 5,375,428 to LeClear et al., herein incorporated by reference, describes an appliance having two compartments and a single evaporator which is selectively placed in communication with each of the compartments. A controller determines which of the two compartments requires cooling. Although satisfactory in some respects, this configuration allows only one compartment to be provided with cold air at a time.

U.S. Pat. No. 4,689,966 to Nonaka, herein incorporated by reference, describes a refrigerator appliance having three compartments—a freezer compartment, a mode-change compartment, and a refrigeration compartment. The mode-change compartment has two temperature sensing dampers. The first damper operates at refrigeration temperatures and the second damper operates at freezer temperature so that the chamber operates at a selected temperature in either the refrigeration or freezing range. This configuration provides only one of three chambers, a minority of the chambers, to be selected between a freezer or refrigerator function.

U.S. Pat. Nos. 4,642,998 to Kang et al. and 4,614,092 to Kim et al., both of which are herein incorporated by reference, each describe a refrigerator-freezer having a manual flap or shutter which allows the freezer compartment to operate as a refrigerator.

Although satisfactory in some respects, none of the devices described in the prior art provide an improved unit having a selectable second compartment which may be cooled simultaneously with another compartment, or which may be easily switched from one mode to another.

SUMMARY OF THE INVENTION

The present invention achieves the foregoing objectives and, in a first aspect, provides an operator selectable refrigerator-freezer unit comprising an enclosure providing first and second compartments, the first compartment being selectable to operate as either a refrigerator or a freezer section, an airway providing communication between the compartments, an air moving and cooling assembly for air within the airway, two airway doors each being independently positionable to enable communication between the airway and the first compartment, a temperature sensor for measuring the temperature of air within the first compartment, and provisions for controlling the position of one of the airway doors depending upon the measured temperature.

In yet another aspect, the invention provides an enclosure defining first and second interior compartments and a divider member separating those compartments, the enclosure further defining a first air duct having a first end in communication with the first compartment and a second end in communication with the second compartment, and a second air duct providing communication between the first air duct and the second compartment, a fan and motor assembly within the first air duct, an evaporator assembly for cooling air within the first air duct, a vent assembly proximate the first end of the first air duct, and a damper assembly disposed proximate to the first end of the first air duct.

DESCRIPTION OF THE PREFERRED EMBODIMENTS

The present invention provides a preferred embodiment refrigerator-freezer unit having an upper compartment and a lower compartment that are separated by a dividing wall. The lower compartment is dedicated as a freezer section and the upper compartment may be selected to provide either a freezer section or a refrigerator section.

As used herein, the expression "freezer" section refers to a cooling section in which the temperature is generally maintained at or below the freezing point of water. The expression "refrigerator" section refers to a cooling storage region maintained at a temperature generally greater than the temperature of the freezer section.

Figure 1:
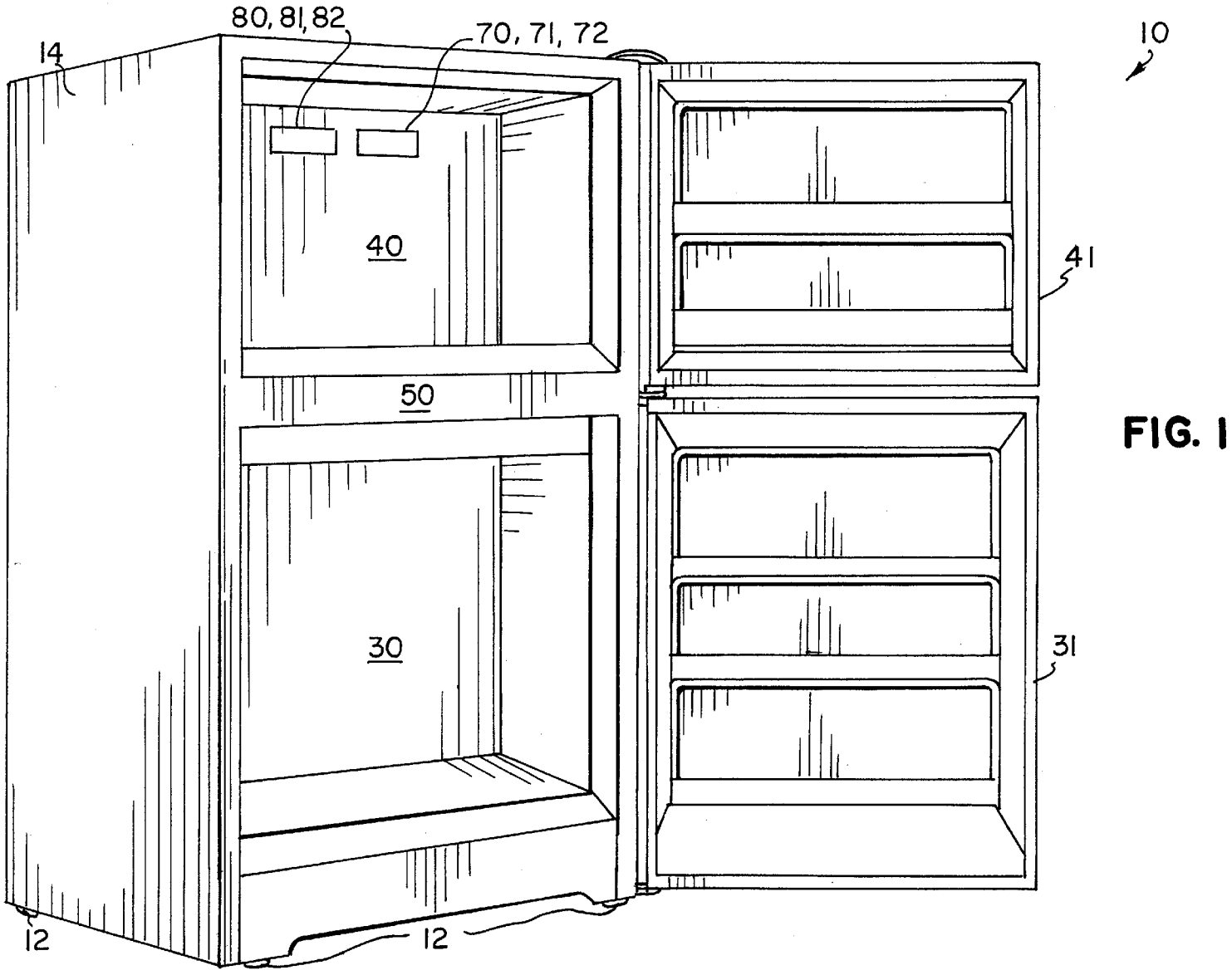
FIG. 1 illustrates a preferred embodiment refrigerator-freezer unit in accordance with the present invention.

FIG. 1 illustrates a preferred embodiment refrigerator-freezer unit 10 in accordance with the present invention. The preferred embodiment unit 10 comprises an enclosure 14 having a base 12 and providing a lower freezer compartment 30 and an upper compartment 40. The compartments 30 and 40 are separated by a dividing wall 50. Hingedly attached to the enclosure 14 is a lower door 31 and an upper door 41.

Figure 3:
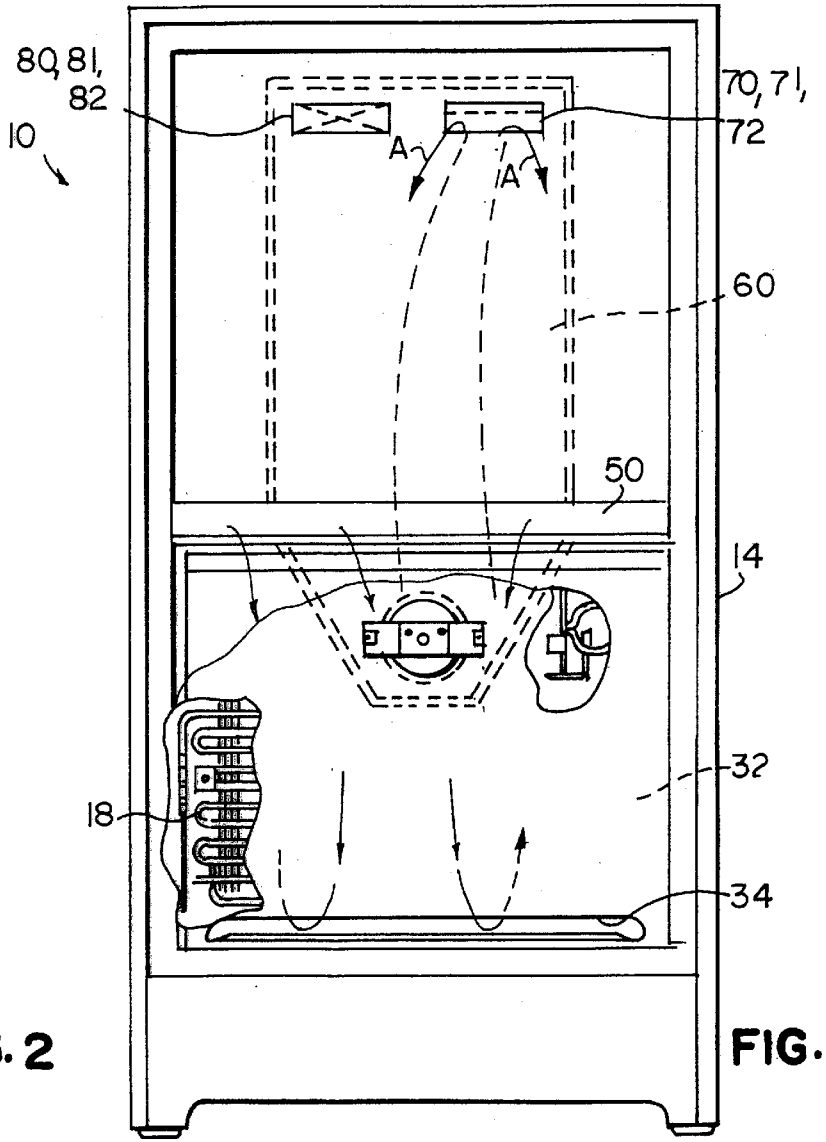
FIG. 3 is a partial front cutaway view of the unit illustrated in FIG. 2 further showing the airflow during a full freezer mode and cooling of the upper compartment.
Figure 2:
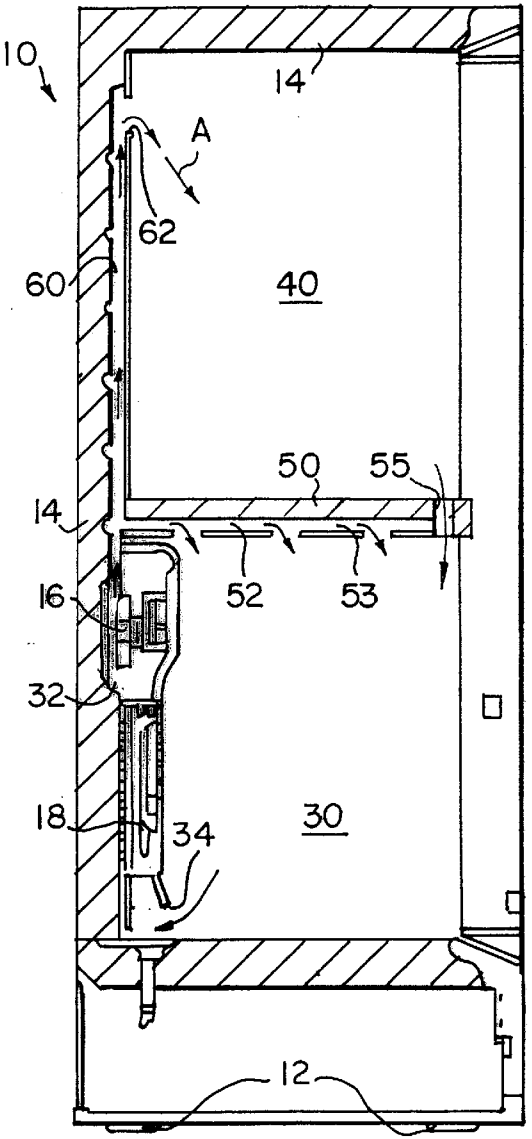
FIG. 2 is a cross-sectional view of the preferred embodiment refrigerator-freezer, illustrating airflow within the unit when the unit is operating in a full freezer mode and the upper compartment is being cooled.

Referring to FIGS. 2 and 3, the preferred embodiment refrigerator-freezer unit 10 is illustrated. The unit 10 further comprises a fan and motor assembly 16 disposed proximate to the rear of the enclosure 14 and conventional cooling coils and evaporator assembly 18 also disposed along the rear of the enclosure 14. A return air duct 32 is provided along the rear wall of the enclosure 14, and specifically along the rear wall of the lower compartment 30. The return air duct 32 extends upward from a return air duct opening 34 defined along the lower rear wall of the lower compartment 30 to the dividing wall 50. The fan and motor assembly 16 and cooling coils and evaporator assembly 18 are in communication with the return air duct 32. The dividing wall 50 provides a generally horizontal air duct 52 extending along its underside. The air duct 52 is in communication with the upper region of the return air duct 32. A plurality of openings 53 are provided along the lower or downward facing surface of the dividing wall 50 to enable air to exit the air duct 52 and enter the lower compartment 30. It will be appreciated that the present invention is not limited to the use of the air duct 52 defined within the dividing wall 50. Instead, an opening in the rear wall of the lower compartment 30 in communication with the air duct 32 could be provided. An upper air duct 60 is provided along the upper rear wall of the enclosure 14, generally vertically along the upper compartment 40. The upper air duct 60 extends between the intersection of the return air duct 32 and the horizontal air duct 52, and an upper duct opening 62 preferably defined along an uppermost portion of the rear wall of the enclosure 14 and in communication with the upper compartment 40. Control of the temperature within the lower freezer compartment 30 is performed by conventional techniques and by utilizing known components. Typically, a temperature sensor and control unit are utilized to regulate the temperature within the lower freezer compartment 30. Generally, the control unit compares the temperature measured within the lower compartment with a preset temperature setpoint value. If the lower compartment is in need of cooling, the control unit activates the air cooling mechanism, e.g. the fan and motor assembly and the cooling coils and evaporator assembly. When the lower compartment reaches the temperature setpoint value, the control unit deactivates the air cooling mechanism.

Disposed generally behind the upper rear wall of the upper compartment 40 are a vent assembly 70 and a damper unit 80. Defined along the upper rear wall of the upper compartment 40 are a vent opening 71 and a damper opening 81, also referred to herein as airway openings. Both the vent opening 71 and the damper opening 81 are in communication with the upper air duct 60 via the opening 62. An airway door is provided for each airway opening. The vent assembly 70 comprises a slidable door 72 which may be slid to various positions to allow passage of air from the air duct 60 through the vent opening 71 or block passage thereof. The damper unit 80 comprises and preferably controls a damper door 82. The damper door 82 governs airflow through the damper opening 81 into the upper compartment 40 from the upper air duct 60. The damper unit 80 preferably controls the relative position of the damper door disposed over the damper opening 81. The damper unit 80 is described in greater detail below.

The lower compartment 30 is dedicated as a freezer section. Accordingly, cooled air flows upward in the return air duct 32 from the fan and motor assembly 16 and the coil and evaporator assembly 18 through the rear wall of the enclosure 14 to the dividing wall 50. The airflow travels through the air duct 52 and exits through the passages 53 provided therein and enters the lower compartment 30. Return air from the lower compartment 30 flows through the opening 34 in the lower rear wall of the lower compartment 30 and into the return air duct 32.

As noted, the upper compartment 40 may be selected to operate as a freezer section or as a refrigerator section. Cooled air driven by the fan and motor assembly 16 is directed upward through the upper air duct 60 to the vent assembly 70 and the damper unit 80. When the vent door 72 is opened, thereby enabling passage of air through the vent opening 71, cooled air enters the upper compartment 40 so that the compartment 40 operates as a freezer section. When the vent door 72 is closed, cold air cannot enter the upper compartment 40 through the vent opening 71.

FIGS. 2 and 3 illustrate operation of the preferred embodiment unit 10 when the upper compartment is selected to operate as a freezer section. In this mode, the vent door 72 is in a retracted or open position so that airflow through the vent opening 71 is not blocked. The damper unit 80 is placed in a condition such that the damper door 82 blocks airflow through the damper opening 81. Typically, the damper unit 80 will contain provisions and a temperature sensor for controlling the position of the damper door 82 relative to the damper opening 81. These features are described in greater detail below. Typically, the damper unit 80 may be configured so that the damper door 82 will remain closed at relatively cold temperatures that are sensed within the upper compartment 40. As shown in FIGS. 2 and 3, cooled air flows through the upper air duct 60 through the vent opening 71, and into the upper compartment 40. This is shown as airflow A. Air exits the upper compartment through a passage 55 defined in the dividing wall 50. It will be understood that when the upper compartment is selected to operate as a freezer, the temperature of the upper compartment generally parallels the temperature within the lower compartment. This is due to the upper compartment receiving air from the air cooling assembly that is controlled according to the temperature within the lower compartment.

Figure 5:
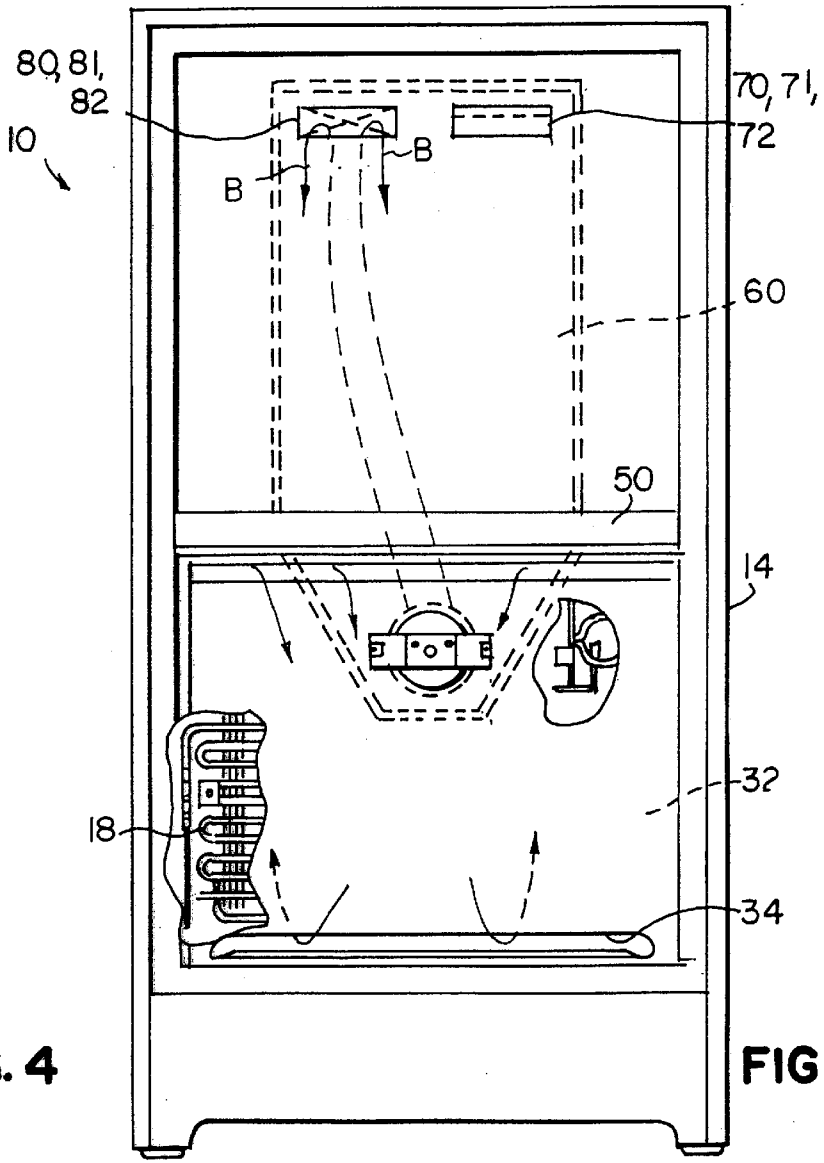
FIG. 5 is a partial front cutaway view of the unit illustrated in FIG. 4 further illustrating the airflow during a combination refrigerator and freezer mode and cooling of the upper compartment.
Figure 4:
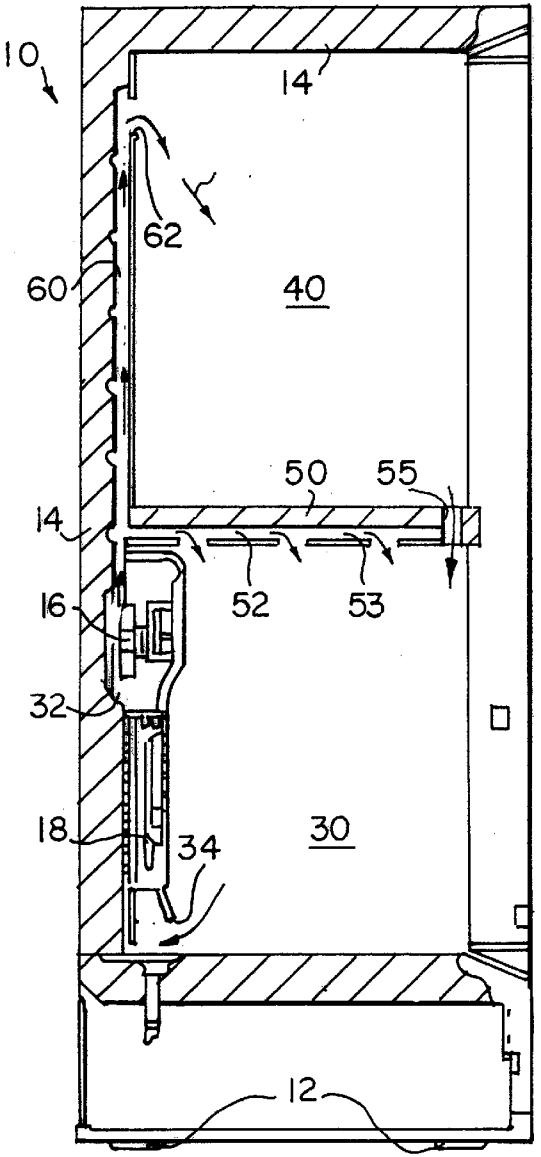
FIG. 4 is a cross-sectional view of the preferred embodiment refrigerator-freezer, illustrating the airflow when the unit is operating in a combination refrigerator and freezer mode and the upper compartment is being cooled.

FIGS. 4 and 5 illustrate operation of the preferred embodiment unit 10 when the upper compartment 40 is selected to function as a refrigerator section. In this mode, the vent door 72 is in an extended or closed position to block airflow through the vent opening 71. The damper unit 80 opens the damper door 82 to allow airflow into the upper compartment 40 when the temperature within that compartment exceeds a predetermined value. This airflow is shown as airflow B. For example, if the damper unit 80 is set at a temperature of 40° F. and the temperature within the upper compartment 40 exceeds that value, and is 44° F. for example, the damper unit 80 will open the damper door 82 to enable cold air from the upper air duct 60 to pass through the damper opening 81. As a result, entry of cold air into the upper compartment 40 reduces the temperature therein.

Figure 7:
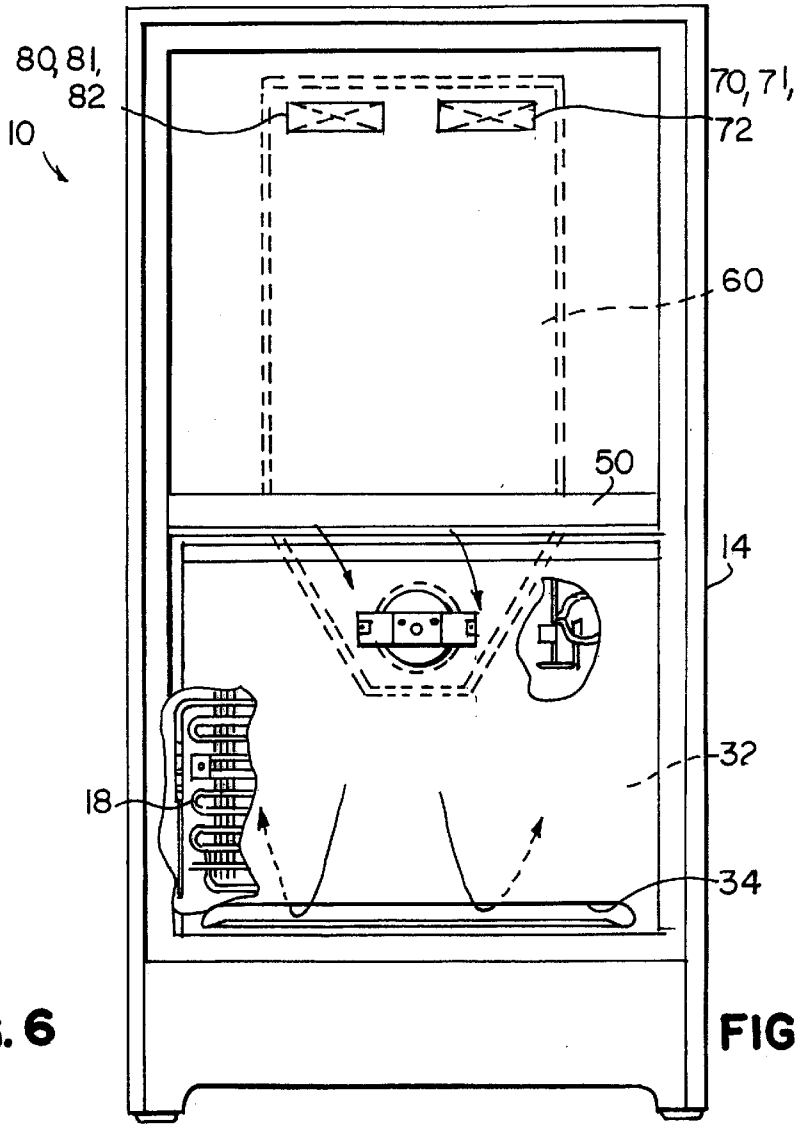
FIG. 7 is a partial front cutaway view of the unit as illustrated in FIG. 6 further illustrating the airflow during a combination refrigerator and freezer mode and without active cooling of the upper compartment.
Figure 6:
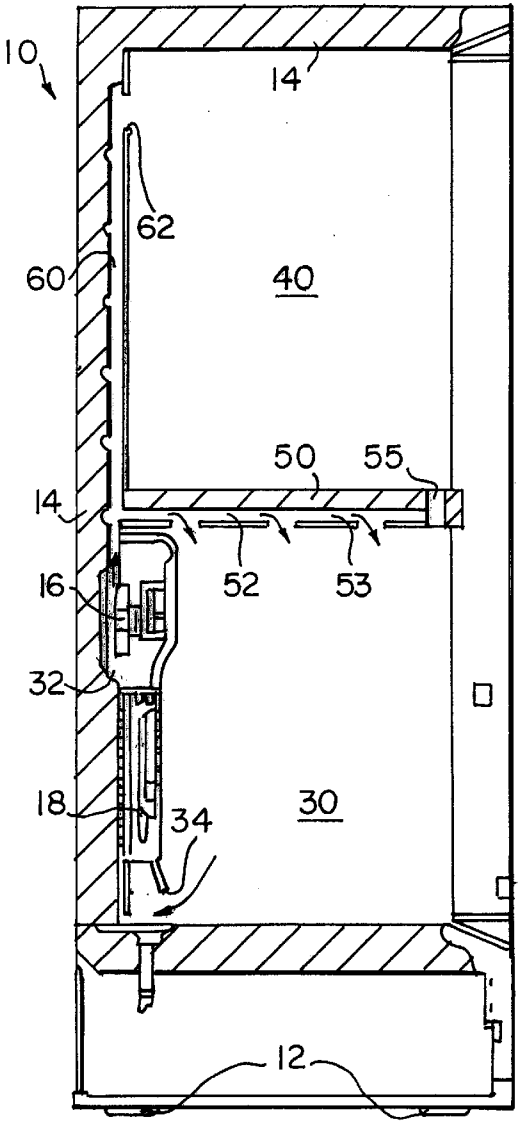
FIG. 6 is a cross-sectional view of the preferred embodiment refrigerator-freezer, illustrating the airflow when the unit is operating in a combination refrigerator and freezer mode and the upper compartment is not being actively cooled.

FIGS. 6 and 7 illustrate the configuration of the unit 10 when the temperature in the upper compartment 40, operating as a refrigerator section, is below the preset or desired temperature for that compartment. If the desired temperature for the upper compartment 40 is 40° F. and the temperature within that compartment is 38° F., the damper unit 80 positions the damper door 82 to block entry of cold air through the damper opening 81. The vent door 72 is in a closed position. It will be appreciated that this configuration enables independent operation of the upper compartment.

The damper unit 80 may be any automatic or semiautomatic airflow regulator preferably having an integral temperature sensing control unit. Preferably, the damper door 82 is integral with the damper unit 80. A most preferred damper unit and door assembly is a refrigerator damper control available from RobertShaw Controls Company of Norfolk, Conn., under the designation RD 10 Series. It is preferred to locate the temperature sensor providing temperature measurement for the damper unit 80, within the upper compartment 40.

It will be understood that a variety of other air moving and cooling assemblies may be utilized besides those described herein, i.e. the fan and motor assembly 16 and the cooling coils and evaporator 18. Moreover, other assemblies may be used in place of the vent assembly 70. For example, it may be desired to utilize a vent door that is hingedly or pivotally movable rather than the slidable door 72. Similarly, other types of positionable doors could be employed in place of the damper door 82. Likewise, instead of utilizing an integral damper and control unit, a separate temperature sensor unit could be employed in conjunction with provisions for positioning the damper door relative to the damper opening depending upon the temperature sensed. The temperature sensor unit preferably senses the temperature within the selectable compartment and provides a control signal representative of that temperature. That measured temperature is compared to a preset or predetermined temperature setpoint value. The difference between the measured temperature and the setpoint value is utilized to instruct the damper door positioning provisions whether to open or close that door. In all of the descriptions herein, it will be appreciated that both the vent door and the damper door may be placed in one or more intermediate positions between a fully closed position and a fully open position.

Testing

A series of tests were conducted using a refrigerator-freezer appliance corresponding to the previously described preferred embodiment refrigerator-freezer unit 10. The unit 10 utilized the previously noted RD 10 damper unit from RobertShaw Controls. In a first series of tests, the unit was configured as a combination refrigerator-freezer, so that the upper compartment was placed in a refrigerator mode. Accordingly, the vent door was closed and the damper unit initiated so that it controlled the temperature in the upper compartment. Table 1, set forth below, summarizes the results of this testing. It can be seen that the upper compartment reached a refrigeration temperature in a relatively short period of time and the temperature was maintained during the duration of the testing.

TABLE 1

| Damper Unit Setting | Day | Time | Bottom Compartment Temperature (°F.) | Top Compartment Temperature (°F.) |
|---|---|---|---|---|
| 4 | 1 | 1:10 p.m. | 11 | 40 |
| 4 | 2 | 1:30 p.m. | 10 | 38 |
| 4 | 2 | 2:15 p.m. | 10 | 36 |

TABLE 1-continued

| Damper Unit Setting | Day | Time | Bottom Compartment Temperature (°F.) | Top Compartment Temperature (°F.) |
|---|---|---|---|---|
| 4 | 2 | 3:45 p.m. | 10 | 36 |
| 4 | 2 | 3:55 p.m. | 9 | 35 |
| 4 | 2 | 7:30 p.m. | 9 | 35 |
| 5 | 5 | 9:00 a.m. | 8 | 34 |
| 5 | 5 | 9:15 a.m. | 7 | 33 |
| 5 | 5 | 10:45 a.m. | 7 | 33 |
| 5 | 5 | 1:00 p.m. | 6 | 33 |

In a second series of testing, the upper compartment was switched from a refrigerator to a freezer mode. This switch was made by opening the vent door. The damper unit automatically closed the damper door upon sensing the relatively cold temperatures within the upper compartment. Table 2 set forth below summarizes the results of this testing.

TABLE 2

| Damper Unit Setting | Day | Time | Bottom Compartment Temperature (°F.) | Top Compartment Temperature (°F.) |
|---|---|---|---|---|
| — | 6 | 1:10 p.m. | — | — |
| 5 | 6 | 3:15 p.m. | 7 | 17 |
| 5 | 7 | 11:20 a.m. | 8 | 19 |

In a third series of tests, the upper compartment was switched back to a refrigerator mode. This was performed by closing the vent door. When the temperature within the upper compartment exceeded the setpoint temperature of the damper unit, the damper unit opened the damper door and thereafter regulated the temperature within the upper compartment by operation of the damper door. The results of this testing are set forth below in Table 3.

TABLE 3

| Damper Unit Setting | Day | Time | Bottom Compartment Temperature (°F.) | Top Compartment Temperature (°F.) |
|---|---|---|---|---|
| 5 | 8 | 11:10 a.m. | 11 | 36 |
| 5 | 8 | 12:50 p.m. | 12 | 39 |
| 5 | 8 | 3:30 p.m. | 11 | 39 |
| 6 | 9 | 7:40 a.m. | 9 | 38 |
| Coldest | 9 | 1:55 p.m. | 5 | 36 |
| — | 9 | — | 5 | 35 |

The results of the described testing demonstrate that the upper compartment can be easily switched between a freezer mode or a refrigerator mode, and that the accompanying change in temperature is effected soon thereafter. Furthermore, the unit reliably maintains that temperature.

Although the preferred embodiment has been described as having an upper compartment which may be selectively configured as a freezer or a refrigerator section, it will be understood that the present invention includes configurations in which a lower compartment may be selectively placed in either mode. Moreover, the present invention includes configurations in which chambers are disposed side by side so that either compartment may be selectively placed in a freezer or a refrigerator mode while the other compartment is dedicated to a freezer mode. Furthermore, the present invention includes embodiments containing more than two compartments with two or more compartments being selectively operable in freezer or refrigerator modes.

While the foregoing details what is felt to be the preferred embodiments of the invention, no material limitations to the scope of the claimed invention is intended. Further, features and design alternatives that would be obvious to one of ordinary skill in the art are considered to be incorporated herein. The scope of the invention as set forth is particularly described in the claims hereinbelow.

What is claimed is:

1. An operator selectable refrigerator-freezer unit comprising:

an enclosure having a plurality of enclosure walls and providing a first compartment defining a first airway opening and a second airway opening in at least one of said plurality of enclosure walls, and further providing a second compartment;

an airway providing communication between said first compartment and said second compartment through said first and second airway openings;

an air moving and cooling assembly adapted for displacing and reducing the temperature of air within said airway;

a positionable first door proximately disposed over said first airway opening;

a positionable second door proximately disposed over said second airway opening;

a temperature sensor unit adapted for sensing the temperature within said first compartment and providing a control signal representative of said temperature; and provisions for positioning said second door relative to said second airway opening based upon said control signal provided by said temperature sensor unit.

2. The refrigerator-freezer unit of claim 1 wherein said first door is slidable between an open position and a closed position.

3. The refrigerator-freezer unit of claim 1 wherein said first compartment is disposed above said second compartment.

4. The refrigerator-freezer unit of claim 1 wherein said first compartment is disposed alongside said second compartment.

5.The refrigerator-freezer unit of claim 1 further comprising:

a divider member separating said first compartment from said second compartment.

6. The refrigerator-freezer unit of claim 5 wherein said divider member defines a second airway providing communication between said airway and said second compartment.

7. A refrigerator-freezer unit having a selectable refrigerator or freezer compartment, said unit comprising:

an enclosure comprising a plurality of walls defining a first interior compartment and a second interior compartment, said enclosure further comprising a divider member separating said first and second compartments, wherein said plurality of walls define a first air duct having a first end in communication with said first compartment and a second end in communication with said second compartment, and a second air duct providing communication between said first air duct and said second compartment;

a fan and motor assembly secured to said enclosure and in communication with said first air duct and adapted for creating an airflow from said second compartment into said first air duct;

an evaporator assembly secured to said enclosure and in communication with said first air duct and adapted for exchanging heat with said airflow;

a vent assembly disposed proximate to said first end of said first air duct, said vent assembly defining a vent opening providing communication between said first air duct and said first compartment, said vent assembly comprising a vent door positionable between a closed position thereby blocking said airflow through said vent opening, and an open position thereby enabling said airflow through said vent opening; and a damper assembly disposed proximate to said first end of said first air duct, said damper assembly defining a damper opening providing communication between said first air duct and said first compartment, said damper assembly comprising a damper door positionable between a closed position thereby blocking said airflow through said damper opening, and an open position thereby enabling said airflow through said damper opening.

8. The refrigerator-freezer unit of claim 7 wherein said second air duct is defined within said divider member.

9. The refrigerator-freezer unit of claim 7 wherein said first compartment is defined proximate to an upper portion of said unit.

10. The refrigerator-freezer unit of claim 7 wherein said second compartment is defined proximate to an upper portion of said unit.

11. The refrigerator-freezer unit of claim 7 wherein said divider member is vertically oriented.

12. The refrigerator-freezer unit of claim 11 wherein said first compartment is defined proximate to a side of said unit and said second compartment is defined proximate to another side of said unit.

13. The refrigerator-freezer unit of claim 7 wherein said divider member is horizontally oriented.

14. A refrigerator-freezer unit having a selectable refrigerator or freezer compartment, said unit comprising:

an enclosure comprising a plurality of walls and including a rear wall, said enclosure providing an upper compartment and a lower compartment, said enclosure further comprising a generally horizontal dividing wall separating said upper and lower compartments, wherein said rear wall defines a generally vertical air duct having a first end in communication with said upper compartment through a vent opening and a damper opening defined in said rear wall and a second end in communication with said lower compartment, and said dividing wall defining a generally horizontal air duct providing communication between said vertical air duct and said lower compartment;

a fan and motor assembly mounted within said enclosure and in communication with said vertical air duct and adapted for producing an airflow from said lower compartment into said vertical air duct;

an air cooling assembly mounted within said enclosure and in communication with said vertical air duct and adapted for transferring thermal energy from said airflow;

a vent assembly disposed proximate to said first end of said vertical air duct and substantially behind said rear wall and said upper compartment, said vent assembly regulating airflow through said vent opening between said vertical air duct and said upper compartment, said vent assembly comprising a vent door positionable between a closed position in which said vent door is disposed over said vent opening and an open position in which said airflow may pass through said vent opening; and a damper assembly disposed proximate to said first end of said vertical air duct and substantially behind said rear wall and said upper compartment, said damper assembly regulating airflow through said damper opening between said vertical air duct and said upper compartment, said damper assembly comprising a damper door positionable between a closed position in which said damper door is disposed over said damper opening and an open position in which said airflow may pass through said damper opening.

15. A method for effecting a change in the mode of operation of a first compartment in a selectable refrigerator-freezer unit from a refrigerator section to a freezer section, said unit comprising: (i) an enclosure having a plurality of enclosure walls and providing said first compartment defining a first airway opening and a second airway opening in at least one of said plurality of enclosure walls, and further providing a second compartment; (ii) an airway providing communication between said first compartment and said second compartment through said first and second airway openings; (iii) an air moving and cooling assembly adapted for displacing and reducing the temperature of air within said airway; (iv) a positionable first door proximately disposed over said first airway opening; (v) a positionable second door proximately disposed over said second airway opening; (vi) a temperature sensor unit adapted for sensing the temperature within said first compartment and providing a control signal representative of said temperature; and (vii) provisions for positioning said second door relative to said second airway opening based upon said control signal provided by said temperature sensor unit; said method comprising:

opening said first door thereby enabling communication between said airway and said first compartment through said first airway opening.

16. A method for effecting a change in the mode of operation of a first compartment in a selectable refrigerator-freezer unit from a freezer section to a refrigerator section, said unit comprising: (i) an enclosure having a plurality of enclosure walls and providing said first compartment defining a first airway opening and a second airway opening in at least one of said plurality of enclosure walls, and further providing a second compartment; (ii) an airway providing communication between said first compartment and said second compartment through said first and second airway openings; (iii) an air moving and cooling assembly adapted for displacing and reducing the temperature of air within said airway; (iv) a positionable first door proximately disposed over said first airway opening; (v) a positionable second door proximately disposed over said second airway opening; (vi) a temperature sensor unit adapted for sensing the temperature within said first compartment and providing a control signal representative of said temperature; and (vii) provisions for positioning said second door relative to said second airway opening based upon said control signal provided by said temperature sensor unit; said method comprising:

closing said first door thereby preventing communication between said airway and said first compartment through said first airway opening; and enabling said provisions to position said second door relative to said second airway opening depending upon the temperature sensed in said first compartment.

* * * * *